United States Patent [19]

Brake

[11] 4,066,209

[45] Jan. 3, 1978

[54] MAILBOX SIGNAL KIT

[76] Inventor: Robert D. Brake, 4051 S. Fairway, Springfield, Mo. 65804

[21] Appl. No.: 649,537

[22] Filed: Jan. 15, 1976

[51] Int. Cl.[2] ..... B65D 91/00
[52] U.S. Cl. ..... 232/35
[58] Field of Search ..... 232/35

[56] References Cited

U.S. PATENT DOCUMENTS

| | | | |
|---|---|---|---|
| 2,754,051 | 7/1956 | Shellabarger | 232/35 |
| 2,924,376 | 2/1960 | Johnson | 232/35 |
| 2,954,920 | 10/1960 | Harger | 232/35 |
| 3,318,516 | 5/1967 | Scheerer | 232/35 |
| 3,606,141 | 9/1971 | Taylor | 232/35 |
| 3,722,460 | 3/1973 | James | 232/35 X |

*Primary Examiner*—Marion Parsons, Jr.
*Assistant Examiner*—Peter A. Aschenbrenner
*Attorney, Agent, or Firm*—Clarence A. O'Brien; Harvey B. Jacobson

[57] ABSTRACT

A kit for adapting a conventional rural mailbox to one which provides a visual signal to advise any one interested that the mailbox has been opened. The kit includes a large signal indicator which is protected within a housing having a transparent portion, said housing being attachable to the rear of a conventional mailbox together with an additional indicator signal which is actuated simultaneously with said first indicator, said second signal being visible from all directions, and latch means for retaining both indicators in a position hidden from view, with additional trigger bar structure attachable to the hinged front door of the mailbox for actuation thereby when said door is opened and movable to release both indicators so that they may drop by force of gravity from their out-of-sight position to a position which is visible.

1 Claim, 5 Drawing Figures

1
2
3
4
5
6
7
8
9
10
11
12
14
15
16
18
19
20
21
22
23
24
25
27
28
30
40
41
42
44
46
48
49
56

MAILBOX SIGNAL KIT

BACKGROUND OF THE INVENTION

1. Field of the Invention

This invention relates generally to signals and indicators for rural type mailboxes for the purpose of indicating to any one interested at some distance from said mailbox whether or not the box has been opened.

2. Description of the Prior Art

One of the problems with known prior art devices is that most of them are much more complicated than necessary, and require extensive modification of conventional mailboxes in order to use the indicators with same.

Another known disadvantage is that the mailboxes must be extensively modified in order to add signals and indicators of known prior art devices.

A still further problem is that many of the known devices provide structure within the mailbox itself which involves a person running the risk of catching or scratching one's hand when reaching into the far interior of the mailbox to retrieve mail which has been pushed to the rear thereof.

A further disadvantage of known devices is that the structure involved with the signals or indicators takes up a substantial amount of the former usable room within the mailbox. Thus the capacity for holding many pieces of mail and/or packages is substantially reduced with these type devices.

In general known prior patents which may be pertinent to the invention are as follows:

W. A. Ward; U.S. Pat. No. 2,807,410; Sept. 24, 1957;
E. O. Scheerer; U.S. Pat. No. 3,318,516; May 9, 1967;
F. R. Taylor; U.S. Pat. No. 3,606,141; Sept. 20, 1971;
E. O. Scheerer; U.S. Pat. No. 3,675,845;July 11, 1972;
E. G. Widham; U.S. Pat. No. 3,709,189; Jan. 9, 1973;
R. E. James, Sr.; U.S. Pat. No. 3,722,460; Mar. 27, 1973.

SUMMARY OF THE INVENTION

An object of the present invention is to provide an indicator kit which is readily attachable to known conventional rural type mailboxes without substantial modification thereof.

Another object of the present invention is to provide an indicator which offers two means of indicating to any one interested that the mailbox to which the indicator is attached has been opened.

A still further object of the present invention is to provide an indicator kit for attachment to a rural type mailbox which is easy to attach thereto, and does not reduce the existing capacity of said mailbox.

Another further object of the present invention is to provide an indicator device which is easily and inexpensively added to conventional rural type mailbox structures.

A still further object of the present invention is to provide a simple, foolproof, easily operated indicator which requires substantially no maintenance and is reliable in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2:
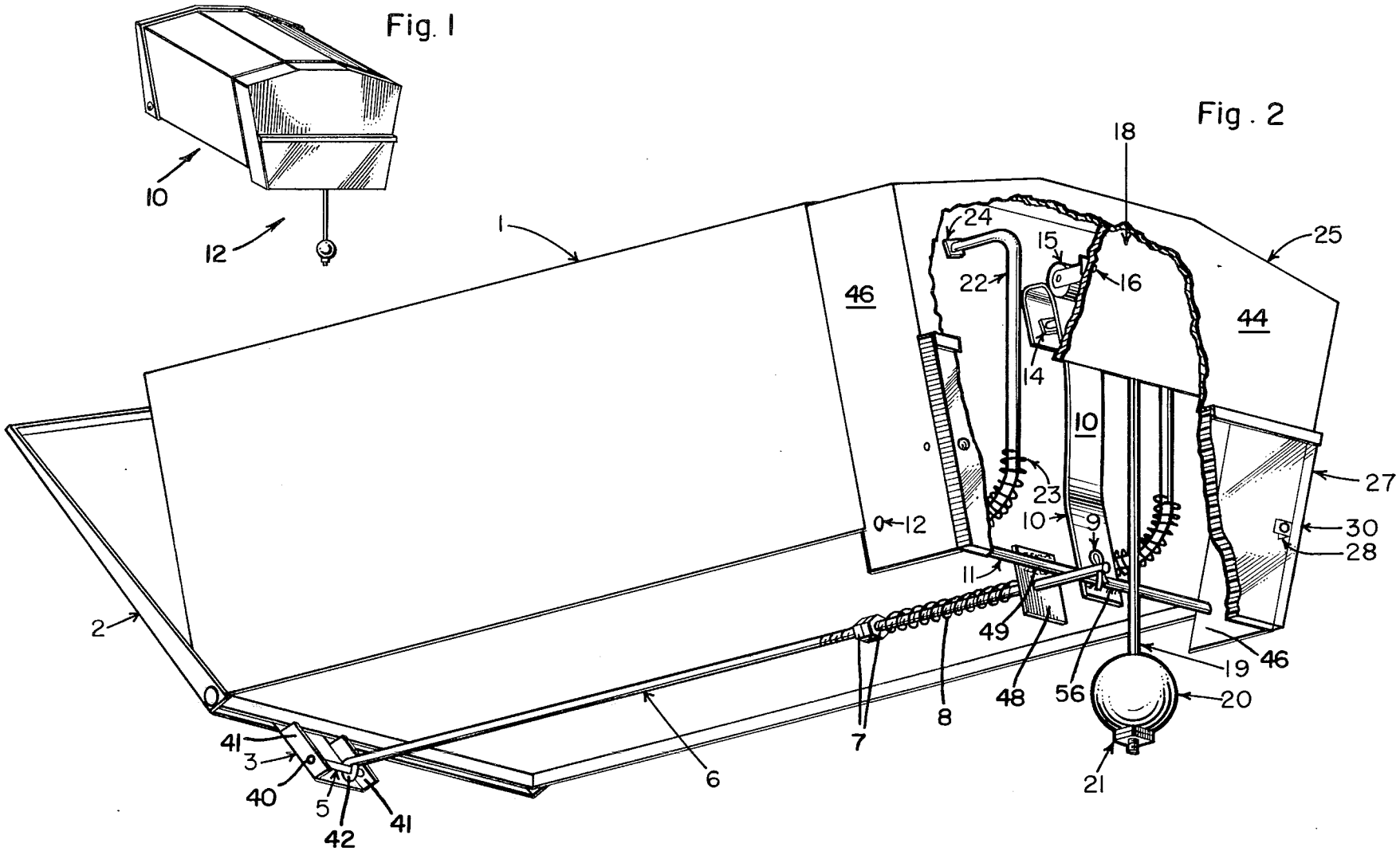
FIG. 1 is a perspective view of the rear of a rural type mailbox having the indicator of this invention attached thereto.
FIG. 2 is a perspective view, partly in cross section, showing the operating mechanism of the indicator kit of this invention.

Referring now more particularly to the drawing, a rural type mailbox is shown generally by reference numeral 10 having attached thereto the signal device of this invention indicated generally by reference numeral 12. The signal indicator of this invention is readily adaptable to any type of rural mailbox shown in FIG. 2 by reference numeral 1. The conventional mailbox door 2 has attached thereto a push rod bracket 3, such bracket being appropriately secured to the door by nuts and bolts or rivets, not shown. The bracket 3 has side flanges 41 to increase the strength of the bracket itself and to resist bending of the bracket and also for the purpose of supporting a pin 5. The ends of the pin 5 may be peened over as at 40 to firmly secure said pin within the flanges 41. A push rod 6 mounts beneath the bottom of the mailbox and is secured at one end of a formed ring 42 about pin 5. Thus it is obvious that as the mailbox door 2 is opened and closed the push rod 6 will move longitudinally and horizontally to release the signal indicator to be described below.

Looking at FIG. 2, the dual signal indicator of this invention is referred to by reference numeral 25 indicating the housing thereof. The housing for the indicator comprises a back wall 44 and side walls 46 appropriately shaped to conform to the shape of the mailboxes for which the indicator will be sold and attached. At the lower portion of the side walls 46 a hinge rod or pin 12 is provided similarly to the pin 5, with the ends of said pin being swaged over to firmly lock the pin between the side walls 46. Pivotally mounted about said pin 12 is a hinge tube 11. Said hinge tube is larger in internal diameter than the outside diameter of pin rod 12 so that the tube 11 can move freely about pin 12. Fastened to the tube 11 by welding or other appropriate means is a short bracket 48 welded at 49 so that when bracket 48 is moved tube 11 will be rotated. Bracket 48 has an aperture therein for reception therethrough of the other end of push rod 6. Near the extreme end of push rod 6 a hole is provided for receiving a cotter pin 9 to prevent rod 6 from withdrawing from the aperture 52. A spring 8 is provided between the bracket 48 and suitable locknuts 7 adjustable along push rod 6 on threads provided at this end of the push rod. Thus it is obvious that when the mailbox door 2 is opened and closed the push rod will cause rotation of tube 11 by means of the spring 8 and the bracket 48. Spaced a short distance from the bracket 48 along the tube 11 is another long, extended trip arm 10 also suitably welded to the tube 11 at point 56. The trip arm 10 has a U-shaped portion at the upper end thereof with a spring 13 attached on the open side portion by means of a rivet, or nut and bolt 14, best seen in FIG. 3.

A signal plate 18, preferably of bright color such as red or orange, is supported for movement up and down within the housing structure by means of two tubes 17 appropriately secured thereto by epoxy glue 72 or other conventional fastening means. Guide rods 22 of substantially U-shaped configuration are mounted on the back wall 60 of the indicator housing and secured thereto by nuts 24 in a conventional manner. Nuts and bolts 26, 26' secure the back wall 60 to the rear wall of the mailbox 1'.

Figures 3, 4, 5:
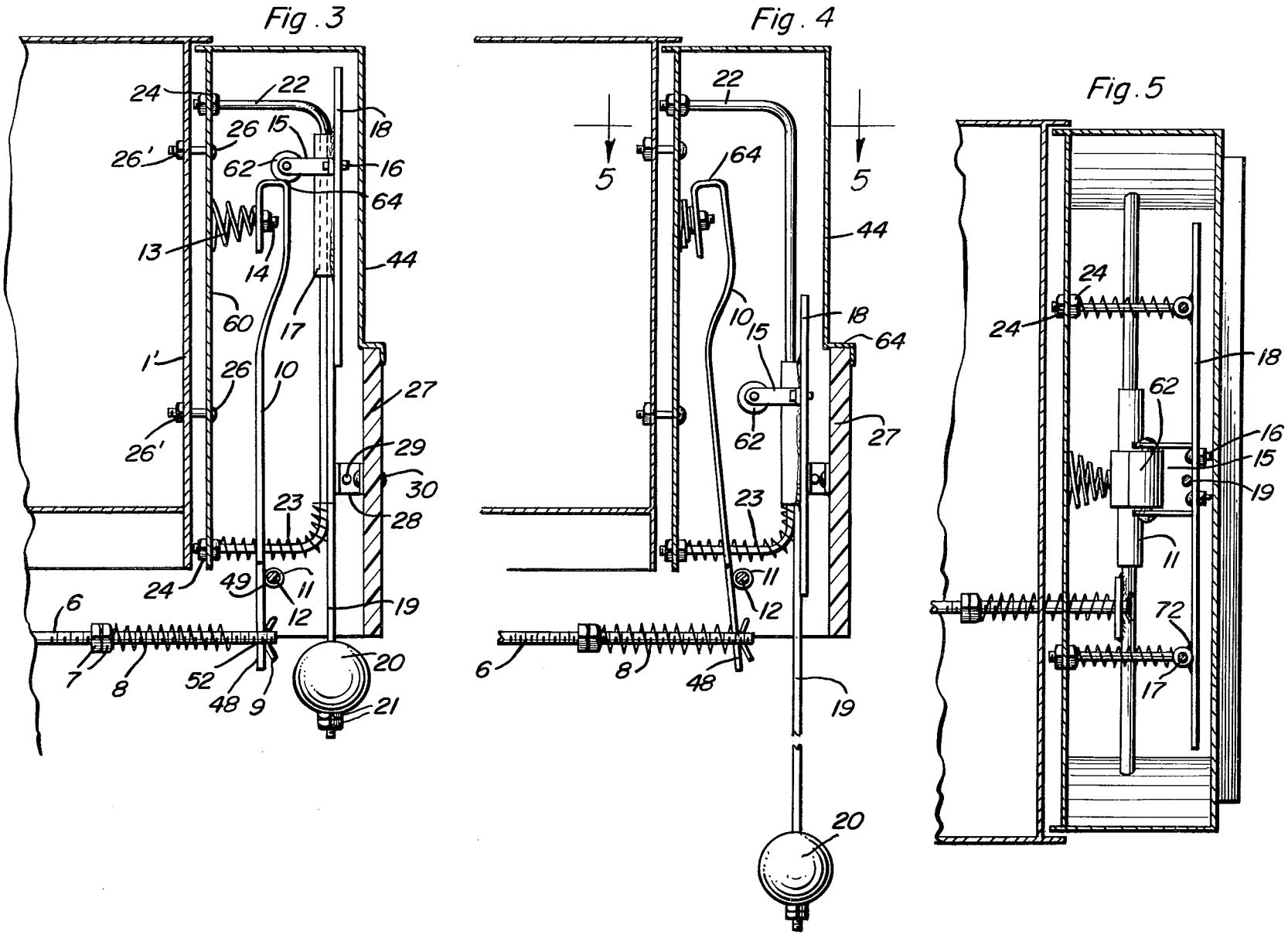
FIG. 3 is a cross-sectional view of the rear of a mailbox having the signal indicator attachment of this invention attached thereto.
FIG. 4 is a cross-sectional view similarly to FIG. 3, but showing the double indicators in signalling position.
FIG. 5 is a cross-sectional view from the top, taken generally along line 5—5 of FIG. 4.

By viewing FIGS. 3 and 4, it can easily be seen how the bright signal plate 18 slides up and down on the vertical portions of the guide rods 22. A buffer spring 23 is provided on the bottom portion of the guide rods 22 to absorb the shock of the plate 18 and tube 17 when they drop by gravity action. Attached to the plate 18 is a bracket 15 appropriately fastened by nut and bolt means 16 thereto. A roller 62 is pivotally mounted on the other end of the bracket 15. Small right-angle brackets 28 secure a glass, plastic or plexiglass portion 27 to the bottom rear of the housing structure 44, 46. An appropriate overhanging flange 64 is provided to cover the joint between the rear housing 44 and the transparent plate 27 for protection against leakage of rain, etc. into the interior of housing 25.

Firmly attached to the central portion of the indicator plate, as best seen in FIG. 5, is a reset rod 19. This reset rod makes it easy to reset the indicator plate to the unactuated and non-viewable position as seen in FIG. 3. One merely has to lift the bottom portion of the rod to raise the indicator plate 18 within the housing and out of sight to the transparent plate 27. An indicator ball 20 is normally also provided on the lower end of rod 19, suitably retained thereon by locknuts 21, the lower end of rod 19 being suitably screw threaded. The signal or indicator ball 20 is also of an appropriate attention attracting color, such as red or orange.

From the above description it can easily be seen that the signal and alarm indicator of this invention comprises basically the push rod bracket 3 for attachment to the hinged mailbox door, the push rod structure 6, 7, and 8, and the rear mounting signal indicator housing 25. Operation of the device is as follows: with the door closed the push rod 6 would be as shown in FIG. 3, to the left, and spring 8 would not be applying any pressure to the bracket 48. The homeowner desirous of knowing when mail has been deposited in the box would have previously lifted the reset rod 19, with its signal ball 20, to the uppermost position as seen in FIG. 3. The roller 62 mounted on the bracket 15 will, in this position, override and be latched by the end 64 of the reset trip arm 10. The spring 13 will bias the trip arm 10 to the right as viewed in FIGS. 3 and 4, since, as seen in FIG. 3, no pressure is being exerted on the lower end of the arm 10 by means of rod 6 and spring 8 through bracket 48 and tube 11. When the mailman comes by for delivery of mail and opens the door 2, the push rod will be moved to the right as seen in FIGS. 3 and 4 whereupon the spring 8, suitably adjusted by locknut 7, will apply pressure to the lower end of bracket 48 which in turn will rotate the tube 11 about pin 12. Rotation of tube 11 will in turn cause rotation of trip arm 10 against the bias of the spring 13 to permit the roller 62 and the associated indicator plate 18 to drop through the force of gravity to the viewable position as seen in FIG. 4. Springs 23 absorbing the shock of such drop.

As seen in FIG. 4, both the indicator plate 18 and the signal ball 20 will in this lowered position be readily visible by anyone interested. The plate 27 will allow the indicator signal 18 to be viewed from the rear or house position of the mailbox and the signal ball 20 will indicate to anyone down the road or coming into the driveway that the mailbox has been opened and supposedly mail deposited therein.

Thus it can be seen from the explanation above how the simple, inexpensive signal indicator structure of this invention may be easily and quickly attached to a conventional rural type mailbox for adding signal features thereto.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A mailbox comprising a receptacle provided with an open end, a vertically swinging hinge door to close said open end, said door having attached to the outer face thereof a bracket extending below the bottom of said receptacle, a signal indicator housing attached to the end of the receptacle opposite to the door, indicator means mounted for vertical movement within said indicator housing and movable from a non-viewable position to a viewable position, actuating means connecting the door-mounted bracket with the indicator means structure, said indicator means including an indicator plate movable vertically for viewing and non-viewing, said plate being mounted on two parallel support rods aligned in a vertical position, a buffer spring mounted on at least one support rod below the indicator plate for absorbing the shock of the indicator plate dropping by means of gravity force from the non-viewable position to the viewable position, a reset rod extending below the indicator housing and connected with the indicator plate for moving the indicator plate from the viewable position to the non-viewable position, a signal ball mounted on the lower end of said reset rod, a latch roller mounted on the indicator plate for retaining the indicator plate in the non-viewable position, a latch arm pivotally mounted within the indicator housing and spring-biased to a latching position with the upper end portion engaged under the latch roller to positively yet releasably retain the indicator plate in the non-viewable position, said actuating means including a push rod extending between the door bracket and the lower end of the latch arm for moving the latch arm against the spring bias to release the latch roller and permit the indicator plate to drop to a viewable position, the upper end portion of the latch arm being offset whereby the roller engages the offset upper end portion of the latch arm and moves it pivotally against the spring bias when the indicator plate is lifted to enable the latch roller to roll past the upper end of the latch arm so that the spring bias will move the upper end of the latch arm into latching position under the roller, said indicator plate being distinguishably colored for easy observation, said housing including an opaque wall portion overlying and concealing the indicator plate when in its lifted non-viewable position, said housing including a lower transparent wall portion overlying and revealing said indicator plate when in its lowered viewable position.

* * * * *